US005985506A

United States Patent [19]

Yuasa et al.

[11] Patent Number: 5,985,506

[45] **Date of Patent: *Nov. 16, 1999**

[54] REVERSAL ELECTROPHOTOGRAPHIC DEVELOPING METHOD EMPLOYING RECYCLABLE MAGNETIC TONER

[75] Inventors: Yasuhito Yuasa, Hirakata; Akinori Toyoda, Katano; Noriaki Hirota, Osaka, all of Japan

[73] Assignee: Matsushita Electric Industrial Co., Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/653,014

[22] Filed: May 24, 1996

Related U.S. Application Data

[63] Continuation-in-part of application No. 08/391,673, Feb. 21, 1995, abandoned, which is a continuation of application No. 08/098,890, Jul. 29, 1993, abandoned.

[30] Foreign Application Priority Data

| | | | |
|---|---|---|---|
| Jul. 29, 1992 | [JP] | Japan | 4-202191 |
| Aug. 4, 1992 | [JP] | Japan | 4-207773 |
| Aug. 4, 1992 | [JP] | Japan | 4-207774 |
| Nov. 19, 1992 | [JP] | Japan | 4-309956 |
| Nov. 19, 1992 | [JP] | Japan | 4-309957 |

[51] Int. Cl.[6] ..... G03G 9/083

[52] U.S. Cl. ..... 430/137; 430/100; 430/106.6; 430/111; 430/125; 430/903

[58] Field of Search ..... 430/100, 106.6, 430/109, 111, 125, 126, 137, 903

[56] References Cited

U.S. PATENT DOCUMENTS

| | | | |
|---|---|---|---|
| 3,105,770 | 10/1963 | Lehmann et al. | 117/17.5 |
| 3,866,574 | 2/1975 | Hardennrook et al. | 118/637 |

(List continued on next page.)

FOREIGN PATENT DOCUMENTS

| | | | |
|---|---|---|---|
| 536040 | 1/1978 | Japan | 430/137 |
| 63-42256 | 8/1988 | Japan | G03G 13/08 |
| 4226476 | 8/1992 | Japan | 430/137 |
| 5-11496 | 1/1993 | Japan | G03G 9/087 |
| 1570239 | 6/1980 | United Kingdom | G03G 9/08 |

OTHER PUBLICATIONS

Akagi et al., "Proc. Symp. on Tech. Innovation on Toner and Developer", The Society of Electrophotography of Japan, pp. 10–14.

Ken Hashimoto, "Material Design of Xerographic Developer", Xerographic Technology Research Lab., Fuji Xerox Co., Ltd., pp. 72–77 (1985).

"Toner and Fine–Grinding/Precisely Classsifying Apparatus."

"Dual–Axial Extruder Corresponding to High Function of Resin Material, 39,5."

(List continued on next page.)

*Primary Examiner*—Bernard Codd
*Attorney, Agent, or Firm*—Wenderoth, Lind & Ponack, L.L.P.

[57] ABSTRACT

A magnetic toner for use in electrophotographic development which can be endowed with high performance by subjecting it to surface treatment with hot air in its dispersed state. The magnetic toner is used in an electrophotographic system including a development process in which an electrostatic latent image is formed by using a photoconductive drum having a stationary magnet therein, and thereafter the magnetic toner is sucked in a toner sump by magnetic force, whereby non-image area toner is recovered by an electrode roller, and the electrophotographic system including a recycle process of the residual toner. The magnetic toner is capable of realizing high-quality image development and stable recycle of residual toner by subjecting the magnetic toner to surface treatment with hot air.

1 Claim, 8 Drawing Sheets

U.S. PATENT DOCUMENTS

| | | | |
|---|---|---|---|
| 4,148,741 | 4/1979 | Bayley | 430/137 |
| 4,292,387 | 9/1981 | Kanbe et al. | 430/102 |
| 4,395,476 | 7/1983 | Kanbe et al. | 430/102 |
| 4,473,627 | 9/1984 | Kanbe et al. | 430/102 |
| 4,758,493 | 7/1988 | Young et al. | 430/106.6 X |
| 4,913,088 | 4/1990 | Kanbe et al. | 118/651 |
| 4,980,256 | 12/1990 | Kato et al. | 430/106.6 |
| 4,999,272 | 3/1991 | Tanikawa et al. | 430/106.6 |
| 5,032,485 | 7/1991 | Kanbe et al. | 430/120 |
| 5,041,351 | 8/1991 | Kitamori et al. | 430/106.6 |
| 5,044,310 | 9/1991 | Kanbe et al. | 118/653 |
| 5,077,169 | 12/1991 | Inoue et al. | 430/111 X |
| 5,077,170 | 12/1991 | Tsujihiro | 430/111 X |
| 5,096,798 | 3/1992 | Kanbe et al. | 430/120 |
| 5,194,359 | 3/1993 | Kanbe et al. | 430/120 |
| 5,232,806 | 8/1993 | Yamada et al. | 430/106.6 |
| 5,351,109 | 9/1994 | Haneda | 355/219 |

OTHER PUBLICATIONS

H. Akagi et al., "Proceedings of Symposium on Technological Innovation on Toner and Developer", pp. 10 to 14, published by the Society of Electrophotography of Japan (May 25, 1993).

J. Nakayama et al., "All–Round Technique Materials of The Latest Super–Fine–Grinding Process Technique", published by the publishing Section of Soft Technical Research, Sep. 1985.

M. Miyazawa, "Plastics", vol. 39, No. 5 (1988) article entitled Dual Axial Extruer Corresponding to High Function Resin Material.

English Translation of JP 4–226476 Nakano et al., Aug. 17, 1992.

REVERSAL ELECTROPHOTOGRAPHIC DEVELOPING METHOD EMPLOYING RECYCLABLE MAGNETIC TONER

This application is a continuation-in-part of now abandoned application, Ser. No. 08/391,673, filed Feb. 21, 1995, which is a continuation of now abandoned application Ser. No. 08/098,890, filed Jul. 29, 1993.

BACKGROUND OF THE INVENTION

1. Field of the Invention

The present invention relates to a magnetic toner for use in an image development apparatus such as a copier, printer, facsimile, and the like.

2. Description of the Prior Art

As a development method in an electrophotographic technique, there have been available conventionally a cascade development method, touchdown development method, jumping development method, and others. Among these methods, the cascade development as disclosed in the U.S. Pat. No. 3,105,770 has been known as a development method in which developer is sprinkled directly onto a photoconductor. The cascade development method was used for the first time in a practical copier for electrophotography.

Further, in the U.S. Pat. No. 3,866,574 disclosed is a development method in which mono-component toner is jumped onto a photoconductor by applying an AC bias voltage to a developing roller thereby to effect development. In this U.S. Patent, the AC bias voltage to be applied to the developing roller is used for the purpose of activating the movement of the toner, where it is described that the toner jumps to image areas and returns on the way to non-image areas on the photoconductor.

As an improvement of the AC bias application technique, there is disclosed a jumping development method in the Japanese Patent No. Publication 63-42256 (published in 1988). In this jumping development method, the toner is supported by a toner support member, and on the toner support member there is provided a doctor blade for regulation of a rigid body or elastic body at a minute distance from to the support member. The toner is formed into a thin layer by the doctor blade and transferred to a developing section, where the toner is deposited on the image areas of the photoconductor with the AC bias application. The technical concept of the Japanese Patent Publication 63-42256 differs from that of the U.S. Pat. No. 3,866,574 in that the toner is moved reciprocatingly at image areas and non-image areas.

As is known, in these development methods, the toners for use in electrostatic charge development are generally composed of resin components, coloring agents of pigments or dyes, and additive components such as plasticizers and charge control agents. As the resin components, natural resins or synthetic resins are used solely or by mixture as the case may be.

However, there has been desired a further improvement in quality of copied images and their long-term stability of image quality in recent years.

Moreover, nowadays, from a viewpoint of environmental protection, it is necessary to regulate unlimited disposal of industrial wastes. It is also important to recycle the wastes.

With the conventional constitutions and methods as described above, it has been well known to those skilled in the art that the cascade development is no good at reproduction of solid blacks. Another problem is involved in the cascade development in that the system for the development method would be large in scale and complex in structure. Further, the developing device as disclosed in the U.S. Pat. No. 3,866,574 has a drawback that high precision is required for the system, which leads to a complex structure and high cost. In the jumping development method, it has been indispensable to form an extremely uniform thin layer of a toner on a toner support member carrying a toner layer. In this method, another problem has been frequently involved in that there occurs a so-called sleeve ghost development in which there remains hysteresis of the preceding image of the toner thin layer formed on the toner support member, which causes an afterimage to appear in the resulting image. The method also has a problem that a complex equipment and high cost are required, disadvantageously.

Therefore, the applicant of the present invention has previously proposed a new electrophotographic system for development which is smaller in size and higher in performance without using a doctor blade. The development process in the new electrophotographic system is implemented by providing a photoconductor containing a stationary magnet, and an electrode roller having a magnet opposed to the photoconductor at a specified spacing. Thus, by this development method, it becomes possible to reproduce solid blacks with fidelity, free from occurrence of sleeve ghost, allowing the system to be further reduced in size, simplified in construction, and lowered in cost.

To improve the quality of images by using this development method, however, there is a need for even higher performance of toner properties. In this development method, since no doctor blade is provided for regulating the toner into a thin layer, the toner is transferred to the development field which is defined by a space of a narrow gap between the photoconductor and the electrode roller, without being formed into a layer. As a result, the place and space needed to obtain a desired charge amount for the toner to be triboelectrified is restricted to only a small one, so that the toner is required to have higher charging characteristic than in conventional one. It is the fluidity and electrical resistance of a surface of toner particles which affects the toner's high charging characteristic. Fluidity can be defined by apparent density, and the surface resistance can be defined by a dielectric loss.

The fluidity of the toners used in the conventional mono-component development or two-component development has drawbacks such that non-uniformities would occur in solid-black image areas and half-tone image areas and besides background fogs would increase in non-image areas. This phenomenon can be found remarkably in toners having low fluidity. This can be attributed to the fact that toners with low fluidity cannot afford satisfactory amounts of triboelectrification due to low possibility of contact with the developing member. Moreover, there arises non-uniformities in the triboelectrification performance among individual toners, so that uniform toner chargeability cannot be obtained. On the other hand, toners keeping high fluidity exhibit uniform contactability with the developing member, so that a high level of charge amount can be obtained, in which case high-quality images can be obtained.

For enhancement of fluidity of toners, there has been taken a measure of increasing an adding amount of additives such as silicon oxide, which is a fluidity imparting agent. However, if additives of such as silicon oxide are increased in quantity, the fluidity increases with an increasing amount of additives, while suspended particles of silicon oxide also increase in amount such that the silicon oxide is implanted as cores into the photoconductor by urging force of a cleaning blade, resulting in flaws. As a result, there would occur a phenomenon of filming that silicon oxide or toner adheres onto the photoconductor. Meanwhile, the suspended particles of silicon oxide adhere to solid black areas, bringing about white dots. In consequence, increasing the amount of silicon oxide results in disadvantages in many respects, offering no solution to the problems.

Conventional magnetic toners have magnetic materials internally added in the binder resin. The toner is pulverized to be finely divided. In this process, since the magnetic material that is lower in electric resistance than the binder resin is exposed on the toner surface, therefore the charges obtained through triboelectrification are likely to leak, such that the magnetic toner encounters difficulty in obtaining large amount of charges, to a disadvantage.

As a further aspect, earth environmental protection has come up to an issue of great significance in recent years. In conventional copiers, laser printers, laser facsimiles, and the like, a toner is developed on the photoconductor in the development process and then transferred onto paper in the transfer process. In these processes, a part of the toner remains on the photoconductor. The part of the remaining toner is swept down in the cleaning process. The cleaned-off toner results in residual toner. In the conventional methods, especially in the mono-component development, the residual toner is wasted, which can not be recycled.

In recycling the residual toner swept off the photoconductor in the cleaning process for once more development, the toners in the conventional method will result in non-uniform charge distribution if the residual toner is mixed with unused toner within the developing unit, such that wrong sign toner of reversed magnetic polarity increases, causing deterioration of the quality of copied images.

Further, the conventional mono-component development is implemented in the arrangement that a toner-layer doctor blade of an elastic body or the like is provided, spaced from the toner support member at a narrow gap or in slightly contact therewith, where a toner thin layer is formed on the toner support member. In this arrangement, it is likely that agglomerations of the residual toner bring about clogging in proximity to the toner-layer regulator blade, causing white voids. The residual toner may have silicon oxide buried into the toner by the pressure involved in the cleaning blade process, resulting in changes in the adhesion state of the silicon oxide or in defects or cracks of the toner. This accounts for deterioration of the fluidity of the residual toner. Such toner that is lowered in fluidity tends to bring about agglomeration. Those factors present difficulties recycling of toner.

The above-described situation results in not only the impossibility of effective utilization of resources, but may cause pollution of the environment as well. Consequently, it is a problem of great urgency to recycle the residual toner for re-utilization of resources, in terms of the environmental protection.

SUMMARY OF THE INVENTION

Accordingly, an essential objective of the present invention is to provide an improvement of a magnetic toner for use in a development method which allows the system to be further reduced in size, simplified in construction, and lowered in cost and moreover, which allows recycling of the toner material, the magnetic toner having high fluidity and high chargeability, in order to realize high quality of images with high image density and low background fogging, preventing filming onto a photoconductor.

Another objective of the invention is to provide a method of manufacturing the magnetic toner which is free from any lowering of toner charge amount and fluidity and free from occurrence of agglomerations even if the residual toner is recycled to be mixed with an unused one.

A further objective of the invention is to provide a magnetic toner which can be designed for prolonged life, which allows recycling development to prevent the earth environmental pollution, allowing re-utilization of resources.

In order to achieve the aforementioned objectives, the present invention provides a method of producing a magnetic toner which comprises at least a binder resin, magnetic materials and additives, characterized in that the magnetic toner is dispersed in a hot air flow having a temperature higher than the softening point of the binder resin so that the magnetic toner is subjected to surface treatment.

The invention also provides an electrophotographic system using the improved magnetic toner, which comprises a development means including: a movable electrostatic latent image retaining member which contains a stationary magnet; a toner sump which is opposed to a surface of the electrostatic latent image retaining member and which feeds the magnetic toner by causing the stationary magnet to suck the toner magnetically; and an electrode roller which is located at a specified interval from the surface of the electrostatic latent image retaining member and which contains a magnet therein, characterized in that, the magnetic toner comprising at least a binder resin, magnetic materials, and additives is manufactured by a method which comprises: the steps of kneading the binder resin, the magnetic material, and as required, the additive; a step of pulverization, and as required, a step of classification to form the magnetic toner; and a step of surface treatment of the resulting magnetic toner by hot air in its dispersed state so as to accomplish the coating of the magnetic materials and the edge-rounding of the magnetic toner simultaneously and instantaneously.

According to another feature of the present invention, the electrophotographic method using an improved magnetic toner comprises: a step of retaining an electrostatic latent image on a latent image retaining member; a step of developing the retained electrostatic latent image to be visualized with the magnetic toner fed by causing the stationary magnet to suck the toner magnetically; a step of transferring the developed image with the magnetic toner onto a transfer member; a step of cleaning the latent image retaining member for removing the magnetic toner partially remaining after the transfer process; and a step of recycling the toner for returning the magnetic toner that has been removed in the cleaning process again to the development process to recycle the same, characterized in that, the magnetic toner comprising at least a binder resin, magnetic materials, the additives is manufactured by a method which comprises: the steps of kneading the binder resin, the magnetic material, and as required, the additive; a step of pulverization, and as required, a step of classification to form the magnetic toner; and a step of surface treatment of the resulting magnetic toner by hot air in its dispersed state so as to accomplish the coating of the magnetic materials and the sphering of the magnetic toner simultaneously and instantaneously.

The magnetic toner of the invention is further characterized in that dielectric loss of the magnetic toner is $3.5\times10^{-3}$ or less. The surface treatment is implemented by a surface treatment apparatus having dispersion means for dispersion-spraying the magnetic toner and hot-air generation means for applying hot air to the magnetic toner sprayed from the dispersion means, and that the temperature of the hot air at which the magnetic toner is subjected to surface treatment is 100 to 600° C.

The method of the invention, when applied, allows improvement in production efficiency by virtue of its continuous fashion. Also, since the surface treatment is carried out in a state wherein the toner is dispersed, it is unlikely that toner particles will be fused with one another, thus preventing occurrence of rough particles. Also, the system involved is very simple and compact in construction. Other advantages include elimination of rise in wall temperature of the system housing, high yield of products, and unlikeliness of dust explosion by virtue of its open type system. There will be no agglomeration of toner particles which one another due to instantaneous hot air treatment, which allows uniform treatment of toner particles as a whole. Bevels of toner particles that have developed during pulverization are completely removed so that the toner is sphered, improving the fluidity of the toner remarkably.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE PREFERRED EMBODIMENTS

Figure 1:
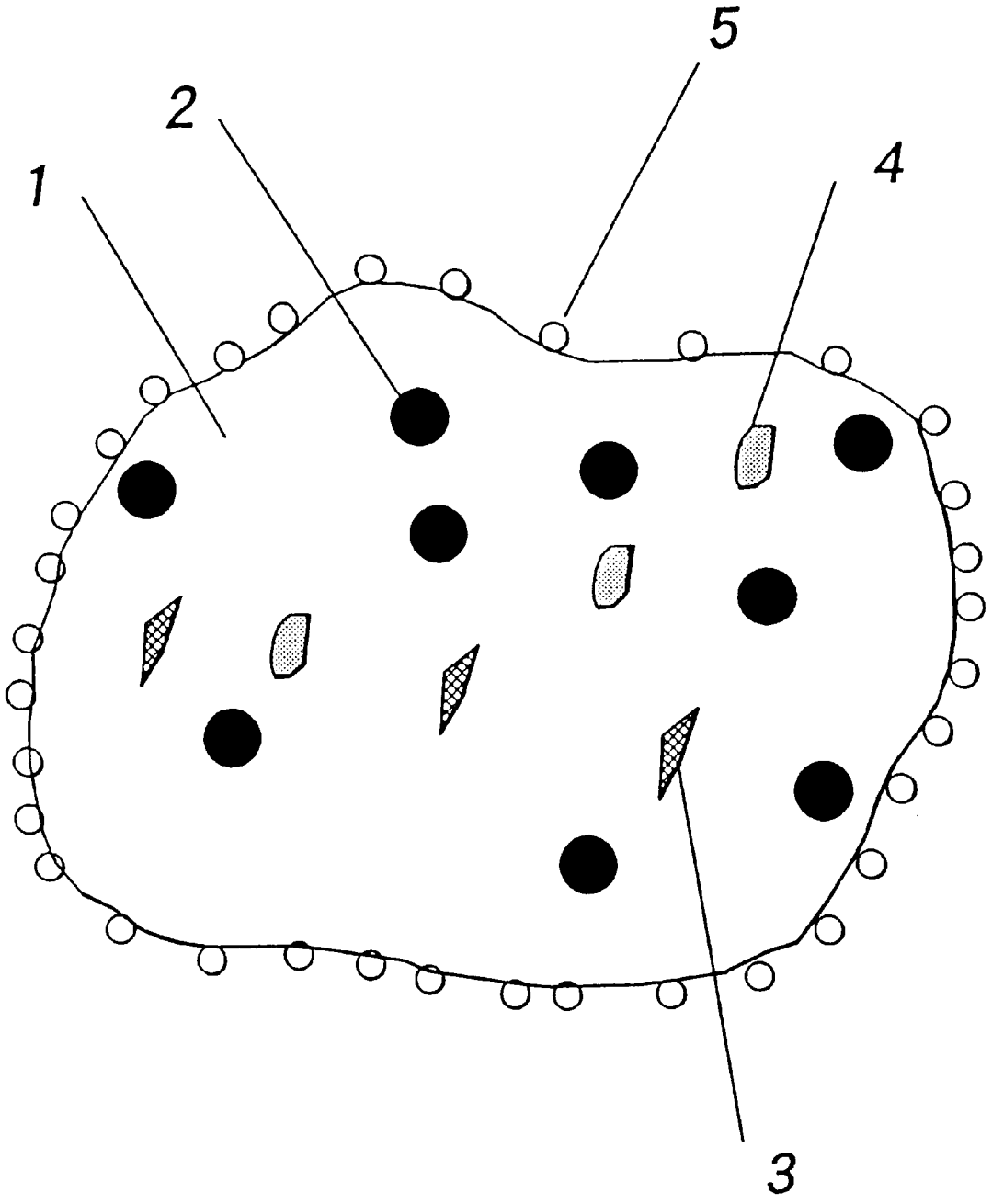
FIG. 1 is a schematic view of the magnetic toner according to the present invention.

The present invention is described hereinbelow in more detail in connection with the attached drawings.

According to the electrophotographic system of the present invention, an electrostatic latent image is formed on an electrostatic latent image retaining member which contains a stationary magnet, and then the toner for the latent image is sprayed on the electrostatic latent image retaining member having an electrostatic latent image formed thereon, so that the toner magnetically adheres thereon is supported and transferred up to an electrode roller, where the toner on the electrostatic latent image retaining member corresponding to non-image areas is removed by electrostatic force and magnetic force by applying an AC bias power to the electrode roller.

In more detail, the electrophotographic system of the present invention utilizes a cascade development method in which a magnet is provided inside the electrostatic latent image retaining member and an AC voltage is applied to the electrode roller, thus allowing the system to be reduced in size and improved in performance.

In this method of the invention, when the toner is first sprayed onto the electrostatic latent image retaining member, the development of the image has almost been completed. The electrode roller portion allows the toner to circulate within a toner sump while it recovers the toner corresponding to non-image areas of the electrostatic latent image. In other words, it is the electrostatic latent image retaining member that supports and transfers the toner from the toner sump to the development section. The electrode roller is opposed to the electrostatic latent image retaining member by its bare face which supports no toner layer. The electrode roller and the electrostatic latent image retaining member rotate in opposite directions with each other.

The magnetic toner for use in the system of the present invention is preferably an insulating mono-component toner. Use of a mono-component toner eliminates the processes of mixing of carrier and toner as well as toner concentration control, which would be involved in the two-component development, thus allowing the system construction to be simplified.

In the electrophotographic method of the present invention, the toner is once adhered to the entire surface of the electrostatic latent image retaining member, and then removing the toner corresponding to non-image areas by electrostatic force and magnetic force by the electrode roller. Thus, in this method the resulting image quality depends largely upon the charging characteristic and fluidity of the toner.

The magnetic toner according to the present invention is produced using known techniques. The toner is subjected to mixing, kneading, pulverization, additive treatment, and as required, classification. Other methods such as the polymerization method also may be used.

In the mixing process, a binder resin, magnetic material, and additives such as charge control agent, detachant, and pigment to be added as required are uniformly dispersed by a mixer or the like having agitators, which process is implemented by known techniques.

In the kneading process, the mixed material is heated and internal additives are dispersed into the binder resin by shear force. The kneading process can be carried out by a known heating kneader. The heating kneader may be either a three-roll type, single-shaft screw type, two-shaft screw type, Banbury mixer type, and the like in which the material to be kneaded is kneaded by heating and applying a shear force.

Agglomerations obtained by the kneading process are roughly pulverized by a cutter mill or the like. The product is more finely pulverized by a jet mill or the like. Further as required, in the classification process, fine particles are cut by a dispersion separator so that a desired particle size distribution can be obtained. It is to be noted that mechanical type of pulverization and classification may also be used in the above process. For example, it may be a method in which the toner is thrown into the minute void between a fixed stator and a rotating roller, where it is pulverized. Also, the classification may alternatively be carried out by classification by centrifugal force derived from the rotating rotor. The classification in either case is a known process.

According to the method of the present invention, the resultant magnetic toner is subjected to surface treatment by applying hot air to the toner that has been pulverized and, as required, classified. In more detail, the toner is dispersion-sprayed from a dispersion nozzle serving as a dispersion spraying means by compressed air, and then hot air heated by a heater serving as a hot-air generation means is radiated to the resulting dispersed and sprayed toner, thus accomplishing the surface treatment.

One case of a conventional practice is to render the surface treatment by heat, whereas in the conventional method the toner is fed into circulating hot air flows for heat treatment, which would easily result in agglomeration among toner particles, such that the toner surface could not be treated into a uniform configuration. Besides in the conventional method of the surface treatment by heat, it would be also likely that dust explosion may occur, due to the hermetically closed system. Furthermore, in the conventional method, the toner is sphered by mechanical impacts, there would occur fusions of toner particles onto the rotating shaft or noise, vibrations, and the like due to presence of a rotating body.

The method of the invention allows improvement in production efficiency by virtue of its continuous fashion. Also, since the surface treatment is carried out in a state wherein the toner dispersed, it is unlikely that toner is particles will be fused with one another, preventing occurrence of rough particles. Also, the system involved is very simple and compact in construction. Other advantages include elimination of rise in wall temperature of the system housing, high yield of products, and unlikeliness of dust explosion by virtue of the open type system. There will be no agglomeration of toner particles to one another due to instantaneous hot air treatment, which allows uniform treatment of toner as a whole. Bevels of toner particles that have developed over pulverization are completely removed so that the toner is made, edge-rounded improving the fluidity of the toner remarkably.

The magnetic toner according to the present invention is subjected to surface treatment by dispersing and feeding the pulverized toner particles into hot air flows. By this treatment, the surface of the binder resin of the toner particles is melted so that the magnetic material exposed on the surface of the toner particles are coated with the binder resin, while the toner particles can be made edge-rounded simultaneously and instantaneously.

As a method of quantitative evaluation of edge-rounded of a toner, the edge-rounding can be obtained in quantity according to values of specific surface areas in a BET method for measuring a general nitrogen adhesion amount. The specific surface area is influenced by a particle diameter, specific gravity and feature of the surface of the toner. In order to obtain the best mode of the fluidity, it is preferable to use a toner having a specific surface area of 0.4 to 4.0 $m^2/g$ under a condition of having a volume mean particle diameter of 6 to 12 $\mu$m and a magnetic material amount of 20 to 60% by weight. In the present embodiment, the quantitative evaluation is carried out using "Flow Sorb II 2300" made by Shimazu Seisakusho Co., Ltd..

In order to effectively perform the surface treatment with uniformity suppressing agglomeration of the toner, it is required to suitably adjust the temperature, air amount and air pressure in balance when in the process of the surface treatment.

It is preferable that, the compression air pressure is set 0.5 to 3.0 $kg/cm^2$ G for feeding the toner from a toner supply source to the inlet of the dispersion spraying means, the hot air flow amount generated by the hot air generating means is set 0.1 to 2.0 $Nm^3/min$, the pressure of the hot air 1.5 to 5.0 $kg/cm^2$, and the temperature of the hot air is set in the range of 100 to 600° C. Further, it is preferable that the caliber of the opening portion of the toner spray means is made smaller than that of toner transporting pipe 32 (see FIG. 4).

Furthermore, by providing a metal mesh 30 having its mesh open value of 30 to 200 $\mu$m at the opening portion of the toner spray means, the toner dispersion can be effectively carried out suppressing the agglomeration of the toner.

The magnetic toner according to the present invention is subjected to additive treatment in which additives are added to toner fine particles which have been obtained through the surface treatment. The additive treatment is implemented by a known agitation with a mixer or the like.

When charge amount of a toner is lowered, the toner will be weakened in image force with respect to the electrostatic latent image retaining member, such that the toner adhering to the electrostatic latent image retaining member will be easily removed by magnetic force with the result of lowered image density. Besides, there will occur larger amounts of toner scattering around characters. It has been found that the clarity of the resulting images is lowered for these reasons.

The magnetic toner according to the present invention is capable of covering magnetic materials exposed on the toner surface with a binder resin, so that the toner can be charged with large amounts of charges. Thus, a high image density can be obtained, free from toner scattering around characters, which allows clear images to be obtained.

Further, dielectric loss of the magnetic toner according to the present invention is preferably $3.5\times10^{-3}$ or less. Dielectric loss of $3.5\times10^{-3}$ or less results in a small amount of magnetic material that is exposed on the magnetic toner surface, where increased surface resistance of the magnetic toner serves to suppress the charges obtained through triboelectrification from leaking. Thus, a magnetic toner which is kept charged with a large amount of charges can be offered.

The dielectric loss was measured in such a manner that the magnetic toner was molded into 12 mm pellets in diameter under a pressure of 100 $kg/cm^2$ and measured at a 1 kHz frequency with an LCR meter.

Lower fluidity of the toner would cause the toner on the non-image area to intensely adhere to the electrostatic latent image retaining member, so that it cannot be removed, which causes background fogging and therefore deterioration of the resulting image. Further, it has also been found that non-uniformities would occur at solid black image areas. If the fluidity of toner is increased by increasing the amount of the additive silicon oxide, the toner is decreased in non-electrostatic adhesion force to the electrostatic latent image retaining member, with decreased background fogging and increased image density, facilitated solution of non-uniformities in solid black image areas. However, there yet occur problems such as filming of silicon oxide to the photosensitive conductor, and white dots of silicon oxide agglomerations adhering to the solid black image areas.

The electrophotographic method proposed in the present invention has such an arrangement that, to make the toner adhere to the entire photoconductor in the development process, the toner and the photoconductor are in contact with each other over a longer period, compared with the conventional mono-component development. On this account, use of a magnetic toner in which the magnetic material is exposed on the toner surface is likely to incur damage on the photoconductor surface. Besides, if a large amount of the additive, silicon oxide, is added to enhance the fluidity of the toner, suspended particles of silicon oxide will be generated, so that the filming of the toner on the photoconductor tends to occur.

However, the magnetic toner of the present invention is capable of imparting high fluidity to the toner by a minimum of hydrophobic-treated silicon oxide through surface treatment. Besides, since the toner has been edge-rounded, silicon oxide can adhere uniformly to the toner in the additive treatment, so that far less amount of suspended particles of silicon oxide will result as compared with the conventional toner that is not sphered. For this reason, there will never occur flaws of the photoconductor or filming due to the suspended particles of silicon oxide. Also, high image quality can be obtained, free from background fogging. Moreover, since the magnetic material is covered with the binder resin, there will be no damage to the photoconductor surface due to the magnetic material. In the magnetic toner of the present embodiment, the additives are preferably of hydrophobic silicon oxide having a specific surface area in a range of 50 to 300 $m^2/g$.

The adding amount of additives is preferably 0.1 to 5.0 parts by weight relative to 100 parts by weight of the magnetic toner. To prevent agglomeration among the toner particles, adding amounts of 0.1 or more part by weight is needed, while 5.0 or more parts by weight would cause silicon oxide to scatter. Although hydrophobic silicon oxide is used as the additive in the present invention, yet other known additives may also be used such as of inorganic fine particles or organic fine particles. It is preferable to use organic fine particles having a volume mean particle diameter of at least 0.01 to 5 pm as he additives.

Further, the electrophotographic system proposed in the present invention has an arrangement of recycling after-transfer toner in development. After-transfer toner is swept off the photoconductive drum by a cleaning blade or the like, resulting in residual toner. In this processing, the toner undergoes a strong stress. In this case, a similar stress is involved if the cleaning method adopts a rigid-body roller, furbrush roller, or the like as well as the blade. In order to provide stable image quality even if the residual toner is recycled, it is necessary for the residual toner to be maintained with large charge amount and high fluidity.

The magnetic toner according to the present invention, which is subjected to sphering treatment, is capable of offering high fluidity. Further, the toner is subject to less decrease in fluidity to the stress which the toner is received from within the developing unit or from the cleaning blade, so that the toner is stable to a great extent.

The toner has proved to have a significant difference in the stability of fluidity from the conventional toner that has not been subjected to surface treatment. From observing the adhesion state of silicon oxide of the residual toner, it was found that the conventional toner has silicon oxide buried in the toner, a great change from the initial state. Conversely, the magnetic toner of the invention was observed to remain almost unchanged in the adhesion state of silicon oxide from the initial state. This may be attributed to the fact that high fluidity helps avoid any stress.

Furthermore, in the present invention, the magnetic toner may be subjected to surface treatment after subjected to the additive treatment to fix the silicon oxide. One of the reasons why the characteristic of toner is changed partially because the adhesion state of the silicon oxide is varied due to the stress. The variation causes the change of the fluidity and charge property. Moreover, the filming to the photoconductor is greatly influenced by the floating silicon oxide particles.

Therefore, the adhesion state of the silicon oxide can be made stable by fixing the silicon oxide, preventing occurrence of filming to the photoconductor.

Furthermore, in the conventional method, organic fine particles are added for improving the cleaning performance. However, simply by adding such organic particles, no satisfactory effect can be obtained. None the less, when there is a part insufficiently added with the particles, the floating particles are agglomerated to cause white lines or black lines on the image undesirably.

In the present invention, the floating particles of silicon oxide are fixed in the process of the surface treatment, thereby suppressing occurrence of agglomeration of the particles, resulting in effective cleaning.

As the organic fine particles, there may be used known materials such as acrylic resin, styrene resin, silicon resin groups and polytetrafluoroethylene, where the volume average diameter of the particles is preferably 0.01 to 5 pm.

In other words, the surface treated toner will undergo less change in the adhesion state of silicon oxide in recycling use, thus able to maintain the high fluidity.

The magnetic toner according to the present invention comprises at least a binder resin, a magnetic material, and an additive.

The binder resin of the magnetic toner according to the present invention is of a vinyl copolymer in which vinyl monomers have been polymerized or copolymerized. Examples of the monomer styrene constituting the binder resin include monocarboxylic acids having double bonds and their substitutes of styrene such as styrene, α-methyl styrene, and P-chlorostyrene, and their substitutes; alkylester acrylate such as acrylic acid, methyl acrylate, ethyl acrylate, butyl acrylate, dodecyl acrylate, octyl acrylate, isobutyl acrylate, and hexyl acrylate; alkylester methacrylate such as methyl methacrylate, ethyl methacrylate, butyl methacrylate, octyl methacrylate, isobutyl methacrylate, dodecyl methacrylate, and hexyl methacrylate.

As the method of producing these copolymers there are available known copolymerization methods such as bulk polymerization, solution polymerization, suspension polymerization, and emulsion polymerization.

The copolymer used for the magnetic toner according to the present invention preferably contains 50 to 95% by weight of styrenic components. Less than 50% by weight of styrene causes the toner to be deteriorated in melt characteristic, insufficient fixability, and worsened pulverizability.

Whereas the magnetic toner according to the present invention has a binder resin like those above mentioned as a main component, other known polymers or copolymers may also be used in addition to such main component, as required. Examples of those are polyester resins, epoxy resins, and polyurethane resins.

The magnetic toner according to the present invention has other known additives added thereto as requiered. As preferred additives, there are known inorganic fine particle materials such as hydrophobic silicon oxide, titanium oxide, aluminum oxide, and zirconium oxide. Whereas hydrophobic silicon oxide, for example, can be obtained in such a manner that hydrophilic silicon oxide obtained by treating silicon tetra-chloride is subjected to further surface treatment, there are available such known treating agents, to which negative-chargeability and hydrophobic property have been taken into consideration, as dimethyl-dichlorosilane, hexamethylenedisilazane, and dimethyl-siloxane, which are all effective to impart hydrophobic property and negative-chargeability.

The magnetic toner according to the present invention has appropriate pigments or dyes blended therewith, as required, for the purpose of coloring and charge control. As such pigments or dyes, there are carbon black, iron black, graphite, nigrosine, metal complexes of azo-dyes, phtharocyanine blue, Du Pont oil red, aniline blue, benzine yellow, rose bengal, and their mixtures, where the blending amount of them depends on the amount of charging and coloring.

The magnetic toner according to the present invention has a detachant further blended therewith as required. The magnetic toner may have other types of additives further blended therewith as required. For example, they are abrasives such as tin oxide, strontium titanate, and tungsten carbide. There may also be added, as required, fine particles of organic material as fluidity aid, charging aid, cleaning aid, and the like.

Still further, the magnetic toner according to the present invention has a magnetic material blended therewith. As the magnetic powder, there are available metal powders of iron, manganese, nickel, cobalt, and the like, and ferrites of iron, manganese, nickel, cobalt, zinc, and the like. Mean particle size of the powder is preferably 1 $\mu$m or less, more preferably 0.6 $\mu$ or less. The amount added is preferably 20 to 60% by weight. Less than 20% by weight of addition likely causes toner scattering to increase, while more than 60% by weight of addition likely causes the toner charge amount to decrease, which leads to deterioration of image quality.

By using the magnetic toner of large charge amount and high fluidity obtained through surface treatment with the above-described arrangement, it is possible to offer high quality of images with high density and low background fogging by a development method which allows the system to be further reduced in size, simplified in construction, and lowered in cost. Furthermore, since the residual toner to be recycled can maintain high fluidity and high chargeability, it being possible to recycle the residual toner, a magnetic toner can be provided which eliminates the need of disposal thereof and which allows prevention of environmental pollution and re-utilization of resources through recycling of the toner.

Hereinbelow, a magnetic toner according to an embodiment of the present invention is described with reference to the accompanying drawings. The present invention is, however, not limited to these examples.

First Embodiment

Table 1 shows an example of the material composition of magnetic toner A according to the present invention.

TABLE 1

| | | |
|---|---|---|
| Binder resin | Styrene-butyl acrylate copolymer resin (monomer ratio: 82/18) Melt viscosity at 135° C.: $1 \times 10^5$ (poise) Melt viscosity at 145° C.: $2 \times 10^4$ (poise) | 62.5% |
| Magnetic material | Magnetite | 35% |
| Charge control agent | Cr-metallized azo-dye | 1% |
| Detachant | Polypropylene | 1.5% |
| Additive | Hydrophobic silicon oxide | 1.0 part |

Figure 4:
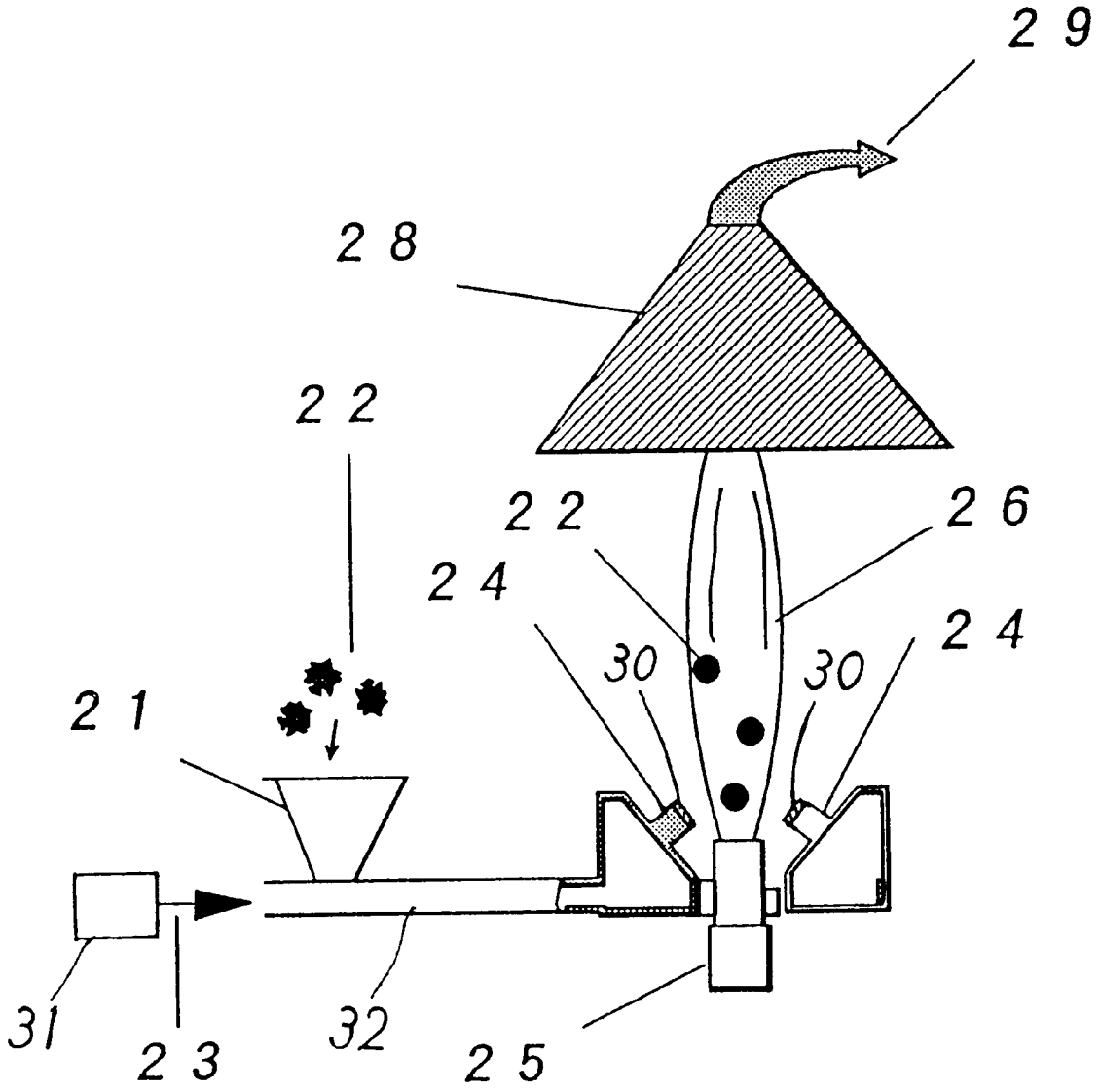
FIG. 4 is a schematic view showing the main part of the surface treatment apparatus for the magnetic toner according to an embodiment of the invention.

A production method of the magnetic toner according to the present invention is described below. The mixture as shown in Table 1 is mixed by a Henschel mixer FM20B (made by Mitsui Miike Engineering Co.). The mixture is heated and kneaded by a two-shaft kneading extruder PCM30 (made by Ikegai Co.). The kneaded product is fine pulverized by a jet mill IDS2 (made by Nihon Pneumatic MFG. Co.). The pulverized fine particles are cut by a dispersion separator DS2 (made by Nihon Pneumatic MFG. Co.). Through these steps, particles with a 8 $\mu$m mean particle size were obtained. Then the particles were subjected to surface treatment at a hot air temperature of 300° C. by the surface treatment apparatus as shown in FIG. 4. Thereafter, hydrophobic silicon oxide of inorganic fine particles was mixed with the surface treated particles for additive treatment by the Henschel mixer FM20B (made by Mitsui Miike Engineering Co.).

An embodiment of the surface treatment apparatus for the magnetic toner according to the present invention as shown in FIG. 4 is now described.

Referring to FIG. 4, a magnetic toner 22 is thrown from a measuring feeder 21 and transferred to dispersion nozzles 24, which are means for dispersing the magnetic toner, by a compressed air 23, from which nozzles the magnetic toner is sprayed in the approximately 45 degrees direction. The compressed air 23 is fed by a compressed air supply unit (31) for supplying the compressed air which contains the magnetic toner dispersed. Furthermore, by providing a metal mesh 30 having its mesh open value of 30 to 200 $\mu$m at the opening portions of the toner spray nozzles, the toner dispersion can be effectively carried out suppressing the agglomeration of the toner.

In the present invention, the dispersion nozzles 24 were provided at least two in number at right-to-left symmetrical positions in the figure. This is because a plurality of nozzles allow the magnetic toner to be treated more uniformly when sprayed therefrom. For radiation of hot air to the magnetic toner 22 sprayed from the dispersion nozzles 24, hot air 26 is generated from a hot air generation device 25. In the present invention, a heater is used for the hot air generation device. The device is not limitative but may be whatever can generate hot air. The magnetic toner 22 disperses and passes with the hot air 26 to be subjected to surface treatment. The surface treated magnetic toner is taken into a hood 28, collected in a cyclone (not shown) located as pointed by arrow, 29.

Also, as shown in FIG. 4, reference numeral 35 denotes a cool air generator for generating cool air 36, which is blown into a cyclone receiver line. The cool air has a temperature lower than 10° C, Reference numeral 41 signifies a recovery box. Reference numeral 40 denotes a cyclone, and 42 is a bag filter. Reference numeral 34 denotes a blower, and 33 denotes an air (amount) measuring unit.

FIG. 1 shows a schematic constitution of a magnetic toner according to the present invention, where reference numeral 1 denotes a binder resin, 2 denotes a magnetic material particle, 3 denotes a charge control agent, 4 denotes a detachant, and 5 denotes hydrophobic silicon oxide.

Figure 2:
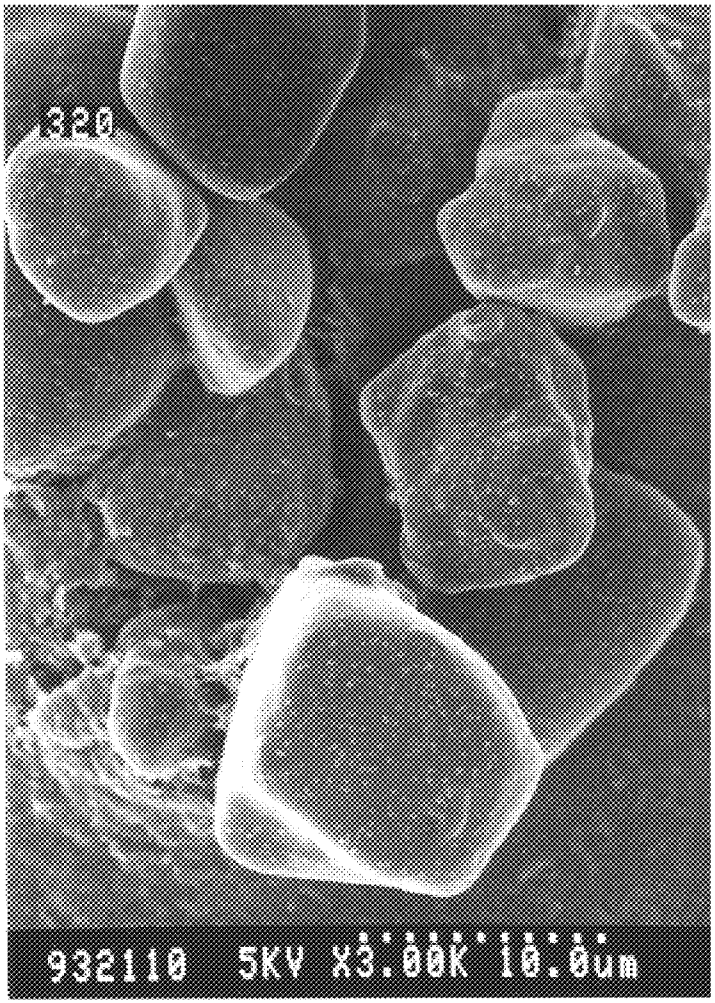
FIG. 2 is a picture of the overall surface of the magnetic toner according to the present invention observed by a scanning electron microscope.

FIG. 2 shows an observational image of the overall surface of the magnetic toner according to the present invention taken by a scanning electron microscope, where the magnifying power is 3,000.

Figure 3:
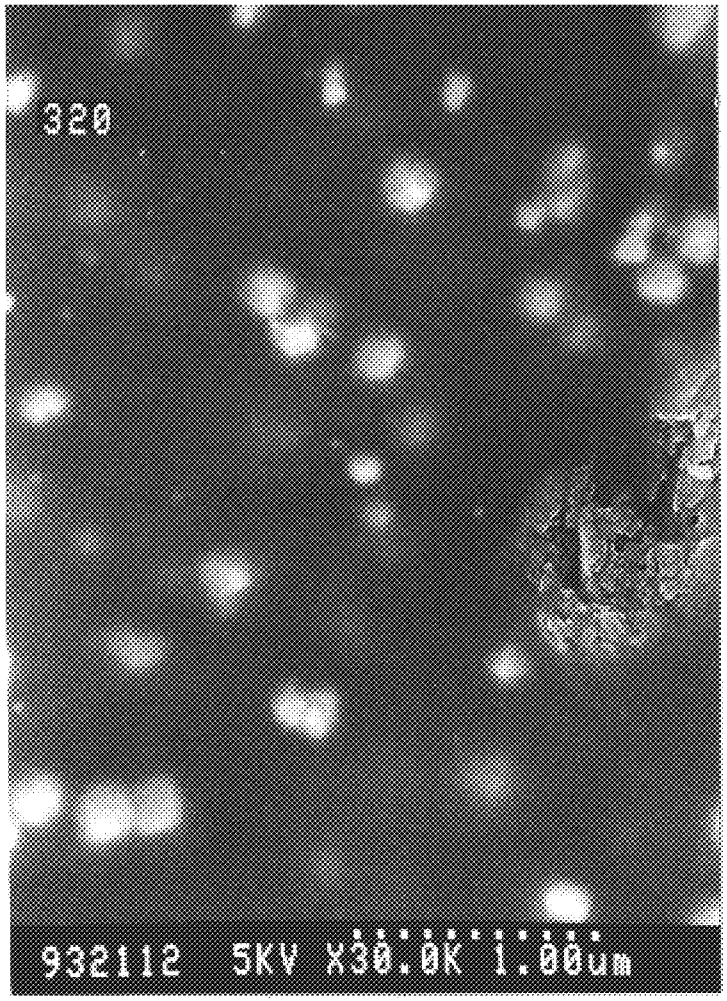
FIG. 3 is a picture of local surface of the magnetic toner according to the present invention observed by a scanning electron microscope.

FIG. 3 shows an observational image of a local surface of the magnetic toner according to the present invention taken by a scanning electron microscope, where the magnifying power is 30,000.

As shown in FIG. 2, the overall configuration of the toner is sphered. In FIG. 3, where it is further enlarged, the image of the magnetic material surface is blurred, which shows that the magnetic material is coated. White dots in FIGS. 2 and 3 represent magnetic material particles.

Physical property values of the magnetic toner A according to the present invention are listed in Table 2. Hot air temperature is selected as a parameter for surface treatment. As a comparative example, physical property values of magnetic toner B that has not been subjected to surface treatment are also listed in the table. Fluidity is defined by apparent density. The measurement was carried out by using a powder tester made by Hosokawa Micron Co. Charge amount was measured by the blowoff method. As measuring conditions, toners were mixed with non-coated ferrite carriers at a toner concentration of 10%, put into a 100 ml polyethylene bottle, and agitated at 60 rpm for 10 min.

TABLE 2

| Toner | Hot air temperature (° C.) | Apparent density (g/cc) | Charge amount ($\mu$C/g) | Dielectric loss ($\times 10^{-3}$) |
|---|---|---|---|---|
| Toner A | 300 | 0.61 | −31.0 | 2.8 |
| Toner A | 350 | 0.64 | −34.0 | 2.4 |
| Toner A | 400 | 0.655 | −36.5 | 2.2 |
| Toner B | – | 0.43 | −20.5 | 5.1 |

It is understood that magnetic toner A clearly shows high fluidity, high chargeability, and low dielectric loss.

Second Embodiment

Figure 5:
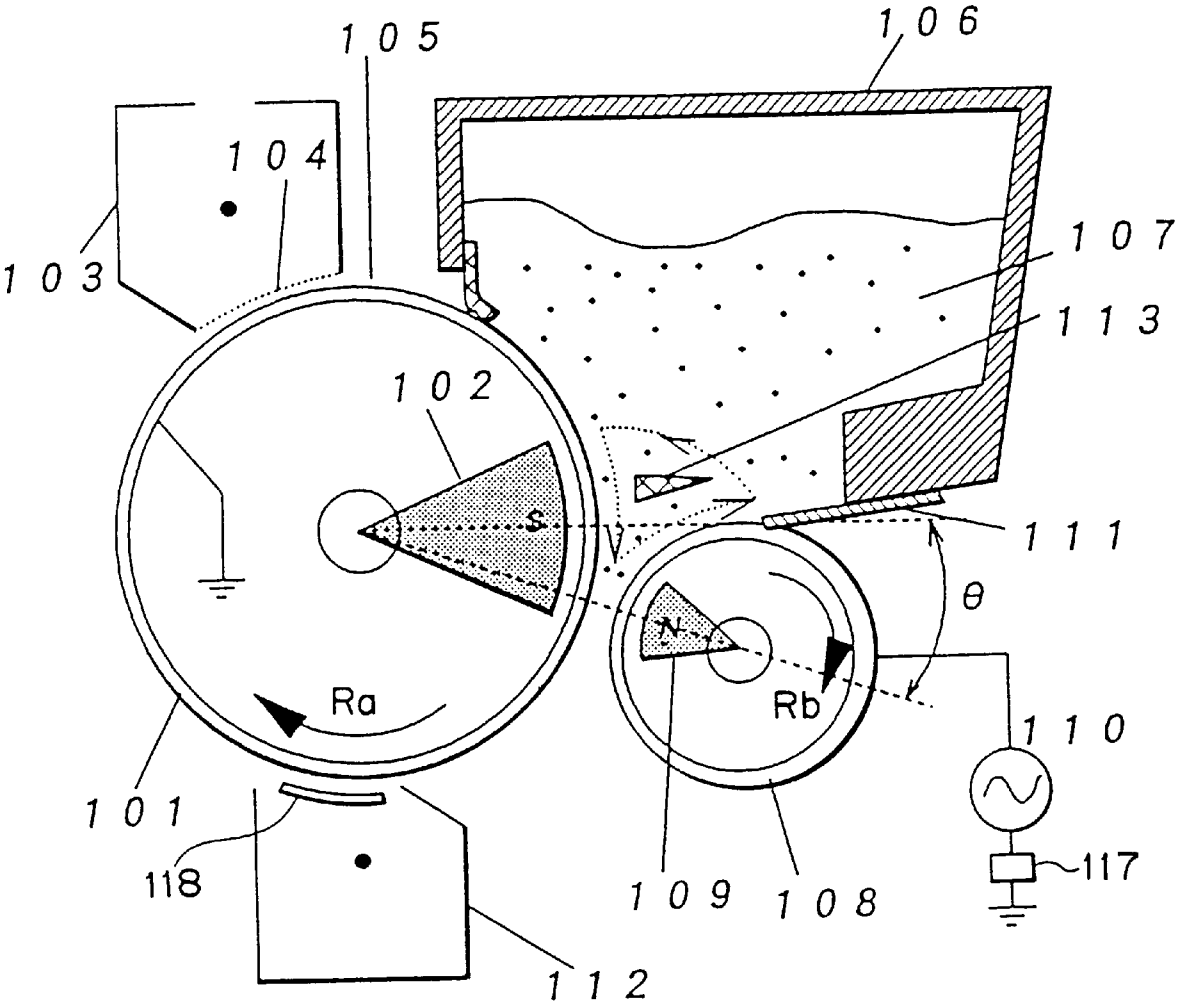
FIG. 5 is a schematic view showing the main part of an electrophotographic apparatus to which the electrophotographic method according to an embodiment of the present invention is applied.

FIG. 5 shows an example of the electrophotographic system according to the present invention. In this development system, there is employed a mono-component magnetic toner. Reference numeral 101 denotes an organic photoconductive drum in which phthalocyanine has been dispersed in polyester binder resin; 102 denotes a magnet fixed coaxial with the photoconductor 101; 103 denotes a corona charger for negatively charging the photoconductor; 104 denotes a grid electrode for controlling the charging voltage of the photoconductor. A laser beam 105 is applied to the surface of the photoconductive drum 101 as a signal light. Reference numeral 106 denotes a toner sump for storing a magnetic mono-component toner 107. Reference numeral 108 denotes a non-magnetic electrode roller set with a gap open to the photoconductor 101; 109 denotes a magnet located inside the non-magnetic electrode roller 108; 110 denotes an AC high-voltage power supply for applying AC voltage to the electrode roller 108; 117 denotes a negative DC bias power supply; 111 denotes a scraper made of polyester film for sweeping off the toner on the electrode roller; and 112 denotes a transfer corona charger for transferring the toner image formed on the photoconductor onto a copying sheet 118 such as paper to be visualized. Further, 113 denotes a damper for smoothing the flow of the toner within the toner sump 106 and preventing the toner from being crushed by dead weight, which may cause binding between the photoconductor 101 and the electrode roller 108.

The magnetic flux density on the surface of the photoconductor 101 is set around 600 Gs. The magnetic force inside the electrode roller 108 is more strengthened, thereby improving the transportability of the toner. The pole angle θ of the magnet 102 as shown in the figure was set to 15 degrees. The photoconductor 101, having a diameter of 30 mm, was rotated at a circumferential velocity of 60 mm/s in the clockwise direction indicated by an arrow Ra in the figure. The electrode roller 108, having a diameter of 16 mm, was rotated at a circumferential velocity of 40 mm/s in the clockwise direction reverse to the forward direction of the photoconductor as indicated by an arrow Rb in the figure. The gap between the photoconductor 101 and the electrode roller 108 was defined by a distance of 300 $\mu$m.

The photoconductor 101 was charged to −500 V by the corona charger 103, where applied voltage was −4.5 kV, Grid ( 104) voltage was −500 V. A laser beam 105 was applied to the photoconductor 101 to form an electrostatic latent image thereon. In this process, the exposure voltage of the photoconductor was −90 V. The toner 107 was made to adhere onto the surface of the photoconductor 101 in the toner sump 106 by the magnet 102. Then the toner adhered portion of the photoconductor 101 was passed by in front of the electrode roller 108. While uncharged areas of the photoconductor 101 passed by, a 750 V0-p (peak-to-peak: 1.5 kV) AC voltage (frequency: 1 kHz) on which a DC voltage of 0 V was superimposed was applied to the electrode roller 108 by the AC high-voltage power supply 110. 750 V0-p indicates that the value of the AC voltage is 750 V with reference to 0 V when no DC voltage is superimposed, where 0-p represents V "zero to peak". Thereafter, while the areas of the photoconductor 101 that had been charged to −500 V to have an electrostatic latent image written therein was passed by, a 750 V0-p (peak-to-peak: 1.5 kV) AC voltage (frequency: 1 kHz) on which a −350 V DC voltage was superimposed was applied to the electrode roller 108 by the AC high-voltage power supply 110. As a result, the toner adhering to the charged portions of the photoconductor 101 was recovered by the electrode roller 108, with the result that there remained a negative-positive inverted toner image of only image areas on the photoconductor 101. The toner adhering to the electrode roller 108 that would rotate in the direction of arrow Rb was swept off by the scraper 111, being returned into the toner sump 106 and used for formation of the succeeding image. The toner image obtained on the photoconductor 101 in this way is then transferred onto paper 118 by the transfer corona charger 112, and subsequently thermally fixed by a fixing unit (not shown), thus producing a copied image.

By using the electrophotographic system as shown in FIG. 5, a copying test was conducted with the magnetic toner A of the first embodiment that had been surface treated. Image density was measured by a reflection density meter (made by Macbeth Co.), followed by evaluation. As a result, an image was obtained which was of extremely high resolution and high image quality, free from any disorder of horizontal lines or toner scattering, uniform in solid black, and in which 16 lines/mm image lines with a density of 1.4 could be reproduced. A high-density image with an image density of 1.4 or more could be obtained. There developed no background fog in at non-image areas.

Third Embodiment

Figure 6:
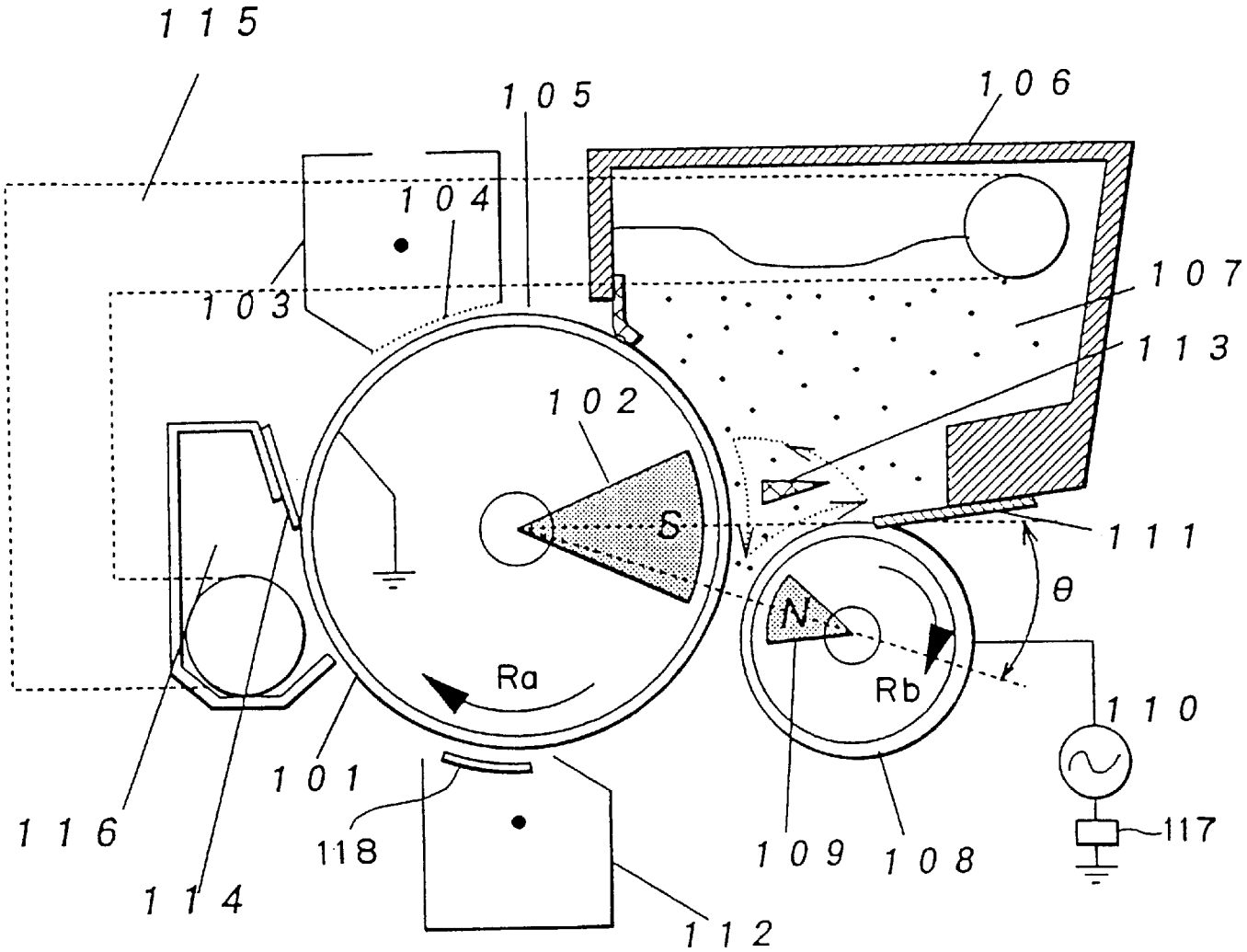
FIG. 6 is a schematic view showing the main part of an electrophotographic apparatus to which the electrophotographic method according to an embodiment of the present invention is applied.

FIG. 6 shows another embodiment of the electrophotographic system according to the present invention. The third embodiment is different from the second embodiment in the fact that the electrophotographic system is further provided with a residual toner recycle process means. Reference numeral 114 denotes a cleaning blade for sweeping off the residual toner remaining after transfer, 115 denotes a transport tube for transferring the residual toner to the toner sump 106, and 116 denotes a cleaning box for temporarily storing the residual toner. The rest of the arrangement is the same as the second embodiment shown in FIG. 5.

By using the electrophotographic system as shown in FIG. 6, a copying test was conducted with the magnetic toner A of the present invention, as shown in the first Embodiment, that had been surface treated. Image density was measured by a reflection density meter (made by Macbeth Co.), followed by evaluation. As a result, an image was obtained which was of extremely high resolution and high image quality, free from any disorder of horizontal lines or toner scattering, uniform in solid black, and in which 16 lines/mm image lines with a density of 1.4 could be reproduced. A high-density image with an image density of 1.4 or more could be obtained. There developed no background fog at non-image areas.

Further, with the residual toner recycled, a long-period copying test was conducted with 10,000 sheets of copy. After 10,000 sheets of copy, it was shown that the toner was free from deterioration in fluidity, high charge amount was maintained, and that there occurred no filming on the photoconductor. High-density, low-background-fogging copied images could be obtained, comparable to the initial images. The toner also exhibited a satisfactory recyclability.

Figure 9:
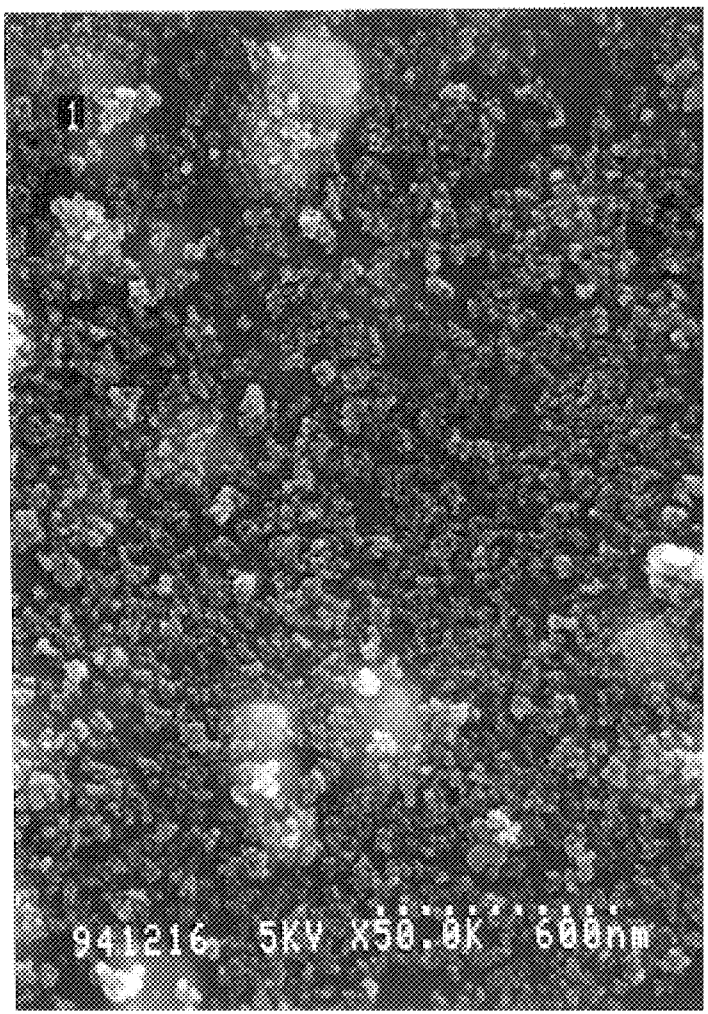
FIG. 9 is a picture of the magnetic toner according to the present invention taken by a scanning electron microscope, showing an observational picture of the adhesion state of silicon oxide in an initial period.

FIG. 9 is a picture of a magnetic toner A according to the present invention observed by a scanning electron microscope, showing a picture of the adhesion state of silicon oxide in the initial period.

Figure 10:
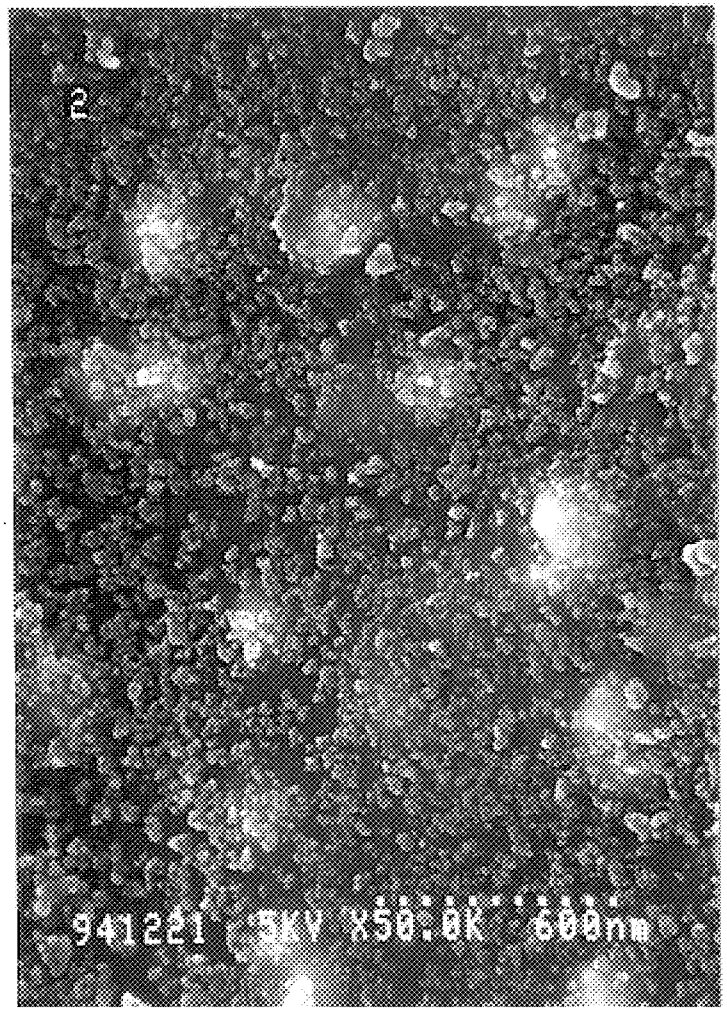
FIG. 10 is a picture of the magnetic toner according to the present invention taken by a scanning electron microscope, showing an observational picture of the adhesion state of silicon oxide after a 10,000 sheet long-time copying test.

FIG. 10 is a picture of the magnetic toner A observed by a scanning electron microscope, showing a picture of the adhesion state of silicon oxide after a long-period copying test of 10,000 sheets of copy, where the magnifying power was 30,000. Large white dots represent magnetic material particles and small fine dots represent silicon oxide particles. Silicon oxide particles could be viewed clearly both in the initial period and after the copying test, showing that the particles maintain their uniform adhesion state.

Table 3 lists the toner fluidity and image density both in the initial period and after the 10,000 sheet copying test.

TABLE 3

| | Apparent density | | Image density | |
|---|---|---|---|---|
| Toner | Initial | After copying test | Initial | After long-period test |
| Toner A | 0.61 | 0.60 | 1.42 | 1.41 |
| Toner B | 0.43 | 0.34 | 1.10 | 0.85 |

It is understood that the toner showed less variation in both fluidity and image density, exhibiting stable characteristics.

Comparative Example 1

Magnetic toner B of Comparative Example 1 is similar in material composition and production method to Embodiment 1 except that it is not subjected to surface treatment.

Figure 7:
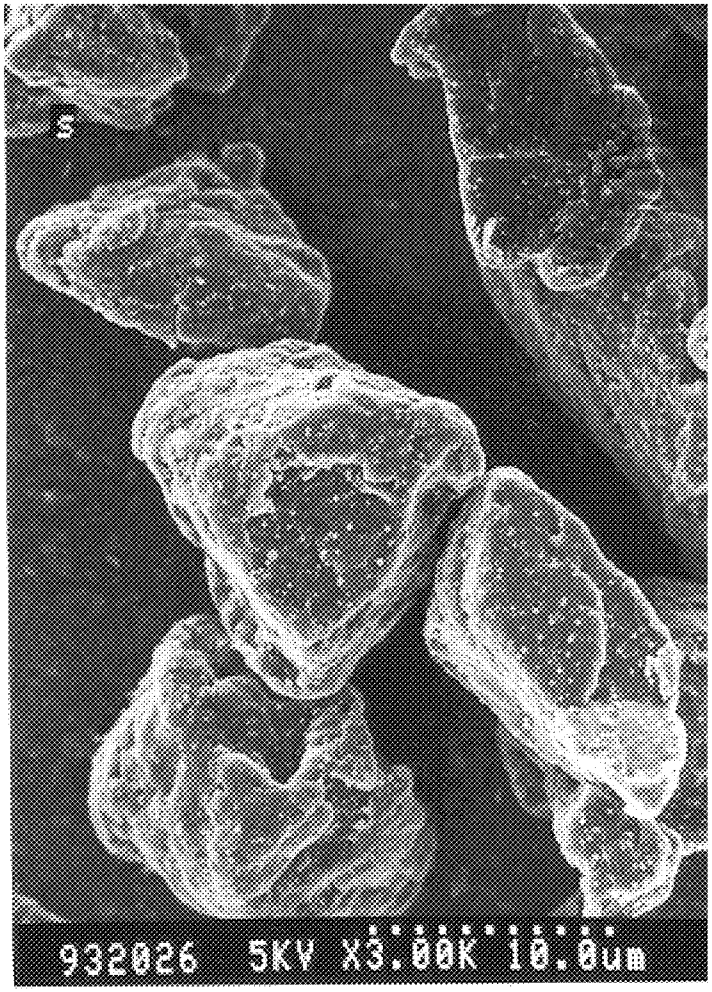
Fig. 7 (Prior Art)
FIG. 7 is a picture of the overall surface of a magnetic toner of the prior art observed by a scanning electron microscope.

FIG. 7 shows an observational image of the overall surface of the prior-art magnetic toner B taken by a scanning electron microscope. It can be clearly seen that the toner configuration is of variable pattern.

Figure 8:
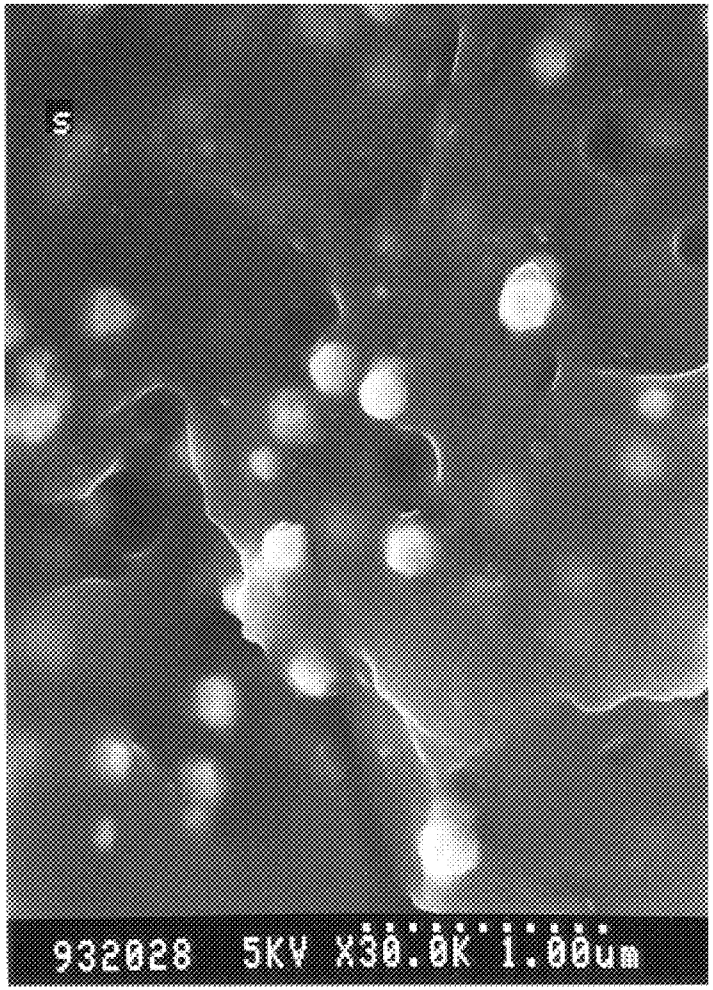
Fig. 8 (Prior Art)
FIG. 8 is a picture of local surface of a prior-art magnetic toner observed by a scanning electron microscope.

FIG. 8 shows an observational image of local surface of the magnetic toner B taken by a scanning electron microscope. It can be clearly seen that magnetic material particles are exposed in the surface.

Physical property values of the magnetic toner B as shown in Table 2 also show that the toner has lower fluidity, lower charge amount, and higher dielectric loss, as compared with magnetic toner A.

If the hot air temperature is 50° C., the resulting physical properties of the toner are equivalent to those of the toner that has not been surface treated.

Also, if the hot air temperature is 650° C., agglomerations were developed to a great amount among toner particles. Besides, other additives are beginning to show thermal damage. Power consumption is too much to allow practical use of the toner.

Comparative Example 2

By using the magnetic toner B that is not subjected to surface treatment as shown in Comparative Example 1, the copying test was conducted by the electrophotographic method presented in Embodiment 2. The resulting image density was no higher than 1.1, there was a large amount of background fogs at non-image areas, so that no practical image could not be obtained.

Comparative Example 3

By using the magnetic toner B that is not subjected to surface treatment as shown in Comparative Example 1, the copying test was conducted by the electrophotographic method presented in Embodiment 3. The resulting image density was no higher than 1.1, there was a large amount of background fog non-image areas, so that no practical image could be obtained. In the long-period copying test, there developed pronounced deterioration in the toner fluidity, lowering of image density, and increase in background fogs at non-image areas.

Figure 11:
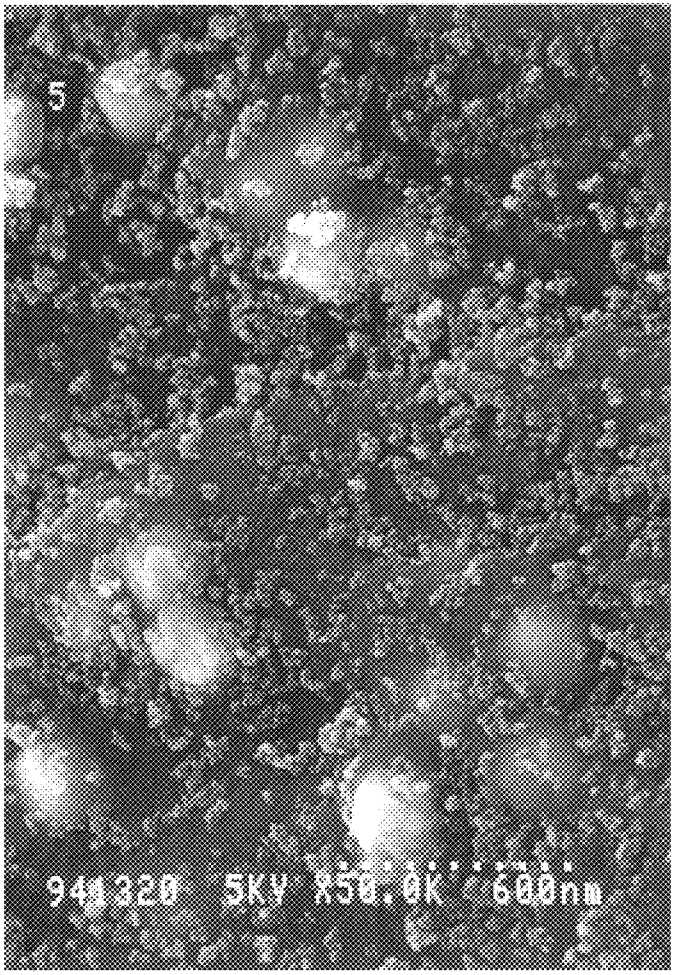
Fig. 11 (Prior Art)
FIG. 11 is a picture of a prior-art magnetic toner taken by a scanning electron microscope, showing the adhesion state of silicon oxide in an initial period.

FIG. 11 is an observational image by a scanning electron microscope, showing the adhesion state of initial silicon oxide.

Figure 12:
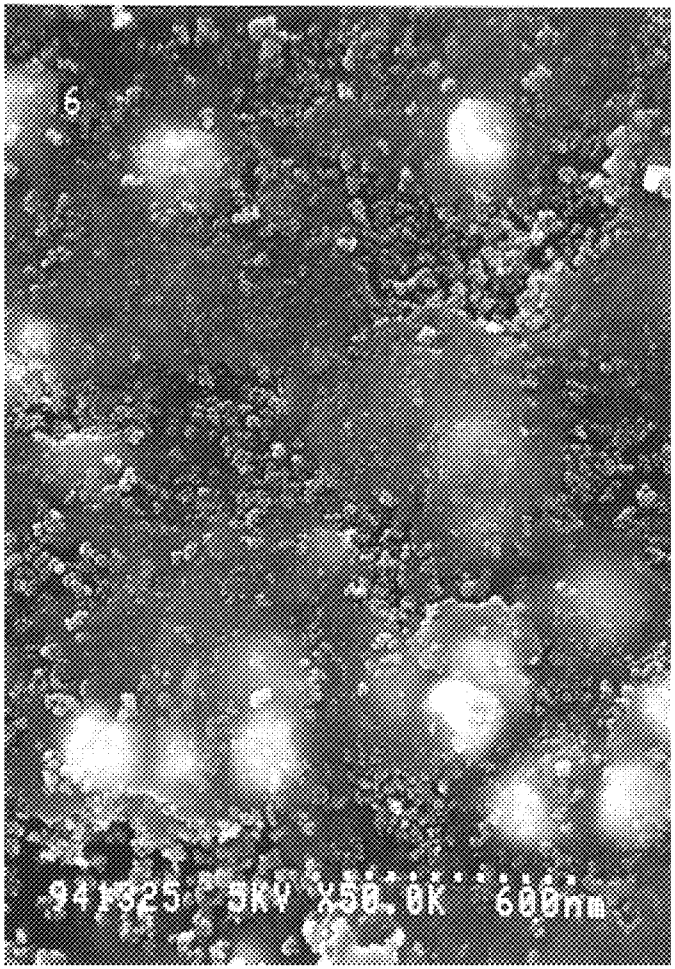
Fig. 12 (Prior Art)
FIG. 12 is a picture of a prior-art magnetic toner taken by a scanning electron microscope, showing an observational picture of the adhesion state of silicon oxide after a 10,000 sheet long-time copying test.

FIG. 12 is an observational image by a scanning electron microscope, showing the adhesion state of silicon oxide after the 10,000 sheet long-period copying test. The magnifying power was 30,000. In the initial state, particles of silicon oxide can be seen, but they adhere in their partially agglomerated state, which is a less uniform adhesion state as compared with Example 3. After the copying test, silicon oxide particles cannot be seen, showing that they are buried in the toner. This accounts for the reduction in fluidity. Table 3 lists the fluidity and image density of the toner both in the initial period and after the 10,000 sheet copying test. It is understood that both fluidity and image density of the toner are deteriorated.

Although the present invention has been fully described by way of example with reference to the accompanying drawings, it is to be noted here that various changes and modifications will be apparent to those skilled in the art. Therefore, unless such changes and modifications depart from the scope of the present invention as defined by the appended claims, they should be construed as included therein.

What is claimed is:

1. A process of producing a magnetic toner wherein i) each particle of said magnetic toner comprises at least a binder resin, a magnetic powder material and additives including polypropylene, said binder resin, magnetic powder and additives being kneaded and dispersed by thermal melting, ii) the product of i) being pulverized into particles, and then iii) instantaneously contacting the pulverized particles of ii) with a stream of hot air having a temperature of between 100 and 600° C. and pressure of 1.5 to 5.0 $kg/cm^2$ so that the surface of the binder resin of the toner particles is melted, whereby magnetic material exposed on the surface of the particles is coated with the binder resin, followed by rapidly cooling said particles with a stream of cool air lower than 10° C., and iv) said magnetic toner having a dielectric loss of at most $3.5\times10^{-3}$, a volume mean particle diameter in a range of 6 to 12 $\mu$m and a specific surface area in a range of 0.4 to 4.0 $m^2/g$.

* * * * *